US010060236B1

(12) United States Patent
Ippolito

(10) Patent No.: US 10,060,236 B1
(45) Date of Patent: Aug. 28, 2018

(54) LOW SLIP PLUNGER FOR OIL WELL PRODUCTION OPERATIONS

(71) Applicant: Joe J. Ippolito, Bakersfield, CA (US)

(72) Inventor: Joe J. Ippolito, Bakersfield, CA (US)

(73) Assignee: LOTRAM LLC, Bakersfield, CA (US)

( * ) Notice: Subject to any disclaimer, the term of this patent is extended or adjusted under 35 U.S.C. 154(b) by 364 days.

(21) Appl. No.: 14/868,848

(22) Filed: Sep. 29, 2015

Related U.S. Application Data

(60) Provisional application No. 62/071,558, filed on Sep. 29, 2014.

(51) Int. Cl.
*E21B 43/12* (2006.01)

(52) U.S. Cl.
CPC ..... *E21B 43/126* (2013.01)

(58) Field of Classification Search
CPC ..... E21B 43/127; E21B 43/126
See application file for complete search history.

(56) References Cited

U.S. PATENT DOCUMENTS 528,436 A 10/1894 Jones
1,579,734 A 1/1925 Pearson
2,180,158 A 11/1939 McCoy et al.
4,084,925 A 4/1978 Stroud et al.
7,686,598 B2 * 3/2010 Williams ..... F04B 47/02 417/430
7,909,589 B2 * 3/2011 Williams ..... F04B 47/02 166/105.2
2007/0154324 A1 * 7/2007 Williams ..... F04B 47/02 417/53
2011/0008180 A1 * 1/2011 Williams ..... F04B 47/02 417/53
2012/0148431 A1 6/2012 Gabriel
2013/0024138 A1 * 1/2013 Mills ..... E21B 47/0008 702/47
2013/0039780 A1 2/2013 Lane

* cited by examiner

*Primary Examiner* — Caroline N Butcher
(74) *Attorney, Agent, or Firm* — James M. Duncan, Esq.; Klein DeNatale Goldner

(57) ABSTRACT

A rod pump plunger is so constructed to collect oil from a produced fluid from an oil well and use it to lubricate the plunger inside of a pump barrel. The plunger has a first sealing structure, a second sealing structure, and penetrating ports in between the sealing structures. A fluid trap which captures oil from the produced fluid flowing through the plunger is formed interior to the body of the plunger and is connected to the port. The trap is connected to a penetrating port such that the trapped oil will flow into the first and second sealing structures. The trap is sized to capture sufficient oil to exceed oil slippage from a pump during each stroke. The oil lubricates the plunger to increase pump efficiency and run life.

19 Claims, 3 Drawing Sheets

LOW SLIP PLUNGER FOR OIL WELL PRODUCTION OPERATIONS

FIELD OF THE INVENTION

The present disclosure generally relates to a low slip plunger utilized within a barrel application in oil well production operations which may include use in artificial lift systems for producing at least two phase flow under pressure. One example would be systems flowing oil and water. The most common example would be a subsurface or downhole rod pump deployed in oil and/or gas wells which also produce water.

BACKGROUND OF THE INVENTION

Newly drilled petroleum reservoirs often produce oil without water. As they produce over time these reservoirs naturally decline in pressure or start making water. In either case the reservoirs typically require artificial lift to continue producing. Sucker rod pumps deployed in wells that produce oil without water typically produce with higher pump efficiencies and longer pump lives. As reservoirs age they naturally began producing increasing water rates as a result of underground aquifers, waterflooding or changes in the reservoir, such as wettability reversal. Pump efficiency and run life commonly decline after water production becomes significant.

Sucker rod pumps are the most common form of artificial lift for oil wells. A surface pumping unit reciprocates a rod string which is attached to a downhole rod pump. The most common surface unit is a walking beam pumping unit which converts rotary motion in a gear box to reciprocating motion in the rod string. Surface pumping units can also be hydraulically or otherwise mechanically driven. While a surface unit is normally connected to a downhole pump with a rod string, there are a number of applications where tubing replaces the rod string. Further classes of artificial lift systems have connected a motor directly to the downhole rod pump. These motors have been hydraulic or linear electrical motors. All these system reciprocate a downhole pump.

The common components of these downhole pumps are the plunger, barrel, standing valve, and traveling valve. Either the plunger or barrel is reciprocated to induce lift. A hydraulic seal formed between the plunger and barrel is fundamental to the process. The seal between the plunger and the barrel enables the pump to lift fluid. The most common sealing mechanism is a close clearance fit between the plunger and barrel as described in greater detail below. Other sealing mechanisms include plungers with ringed elements around the plunger that bridge the gap between the plunger and barrel. These elements have been made of a number of different materials. This type of sealing mechanism is typically deployed in wells that produce sand or other solids. This type of sealing mechanism does not currently appear to be effective in improving run lives in well with limited or no solids.

Close clearance seals function by forming a small gap between the plunger and the barrel which extends along the length of the plunger. The industry has defined pump "Fit" as the difference between the I.D. of the barrel and the plunger O.D. Fit is generally somewhere between two and eight thousands of an inch. The Fit allows a certain amount of fluid slippage between the plunger and barrel in order to lubricate the relative motion of the plunger and barrel. Too little fluid slippage will damage the plunger and barrel. Poor plunger lubrication is a major cause of pump failure. Excess slippage is also a major cause of pump failure, because excessive slippage results in the eroding or wearing away of the materials of the plunger and barrel. In addition, too much slippage will reduce pump efficiency and increase energy usage. Finding the optimum fluid slippage is often a well-by-well process that can change over time with changing well conditions.

Artificial lift designers typically allow fluid slippage of at least 5% of the produced fluids. However, pump failures have compelled many users to go to much higher slip rates. It is now understood that the rod pumps will slip produced water. Slipping corrosive salt water reduces plunger and barrel lives. The plunger slips fluid during specific points in the pumping cycle. By the time the pump reaches that point, the produced oil has floated away from the plunger. The water is left behind to slip around the plunger. In addition fluid slippage is inversely proportional to fluid viscosity; therefore a plunger will slip more water than oil under the same conditions.

The traveling valve is typically attached to the reciprocating plunger. However there are configurations with a moving barrel and a stationary plunger where the traveling valve is a component of the barrel. The standing valve is typically attached to the entrance of the stationary member such as the barrel, plunger, or tubing. Both these valves function as check valves; fluid only travels up into and through the pump. Therefore each stroke of the pump lifts the fluid column the length of the downhole stroke. Slippage is the volume of fluid that flows around the plunger and collects in the barrel below the plunger.

During the upstroke the traveling valve closes and the standing valve opens. The rod string lifts the plunger which lifts the fluid column. Produced fluids enter the barrel under the plunger. These fluids remain in the barrel, while waiting for the plunger to return to the bottom of the stroke, where they separate into layers of gas, oil and water. The gas is above the oil which is above the water. On the downstroke the traveling valve opens and the plunger travels through these fluid layers down to the bottom of the stroke. On the next upstroke the plunger will slip the water which is directly above the plunger. Well analysis has confirmed the preferential slippage of water over the slippage of oil.

By way of illustration, a rod-pumped well with a 144 inch stroke length and 50% water cut would have a water layer 6 feet in length standing in a stationary pump barrel. During the downstroke these layers pass through the center of the plunger and become part of the fluid column above the plunger. Therefore the 6 foot water layer would extend well above the top of a typical 3 foot plunger. In addition the gas and oil layer floats up the tubing away from the plunger. During the upstroke the traveling valve closes and the fluid is lifted, such that the pressure above the plunger is higher than below the plunger. This pressure differential induces fluid slippage around the plunger. The upstroke begins at the bottom of the stroke while the plunger is in the water layer. Therefore the plunger must slip or leak all of the water before the plunger-barrel interface is lubricated with oil. On the next stroke the plunger will pick up the water that was slipped from the previous stroke and any additional produced water. Therefore pumps will build sufficient water until they ultimately slip only water. This occurs even if produced water rates are relatively low.

SUMMARY OF THE INVENTION

Embodiments of the disclosed invention provide solutions to the problems of plunger slippage and wear. Slipping corrosive salt water around a downhole rod pump plunger limits the pump's run life. Plunger performance is improved by providing a plunger that captures produced oil and uses it to slip around the plunger forming a tighter seal between the outside surface of the plunger and the inside wall of the barrel. In addition, the oil layer between the plunger and the barrel improves plunger lubrication therefore increasing plunger run life. In addition, increased pump efficiency increases pumped volumes and reduces energy usage. Embodiments of the present invention may be utilized for other subsurface systems which utilize plunger/barrel combinations. For example, U.S. Pat. No. 9,151,141, issued to the inventor herein, discloses plunger/barrel combinations which may be used in providing downhole counterbalance. The '141 patent is incorporated herein, in its entirety, by this reference.

In downhole pump applications, the downhole pump comprises a barrel, a plunger, and valves. The barrel has a first one-way valve. The plunger is located within the barrel so that either the plunger or the barrel reciprocates with respect to the other. The plunger has a second one-way valve. This reciprocation forces the oil, water, and any natural gases to flow through the pump. The plunger has a first sealing structure and second sealing structure. These sealing structures can be any of the types currently used by the industry. These sealing structures typically allow the slippage of fluid across the seals. A means to distribute fluid from inside the plunger is placed in between the two sealing structures. This fluid is distributed round the perimeter of the plunger. This can be accomplished by using channels and a number of ports or holes thorough the plunger wall. A fluid trap is formed interior to the body of the plunger. The trap extends out into the interior of the plunger in a manner that captures a portion of the fluids flowing through the pump. These trapped fluids will naturally separate into layers of gas, oil, and water. The trap is connected to the ports such that the trapped fluids are free to flow into the first and second sealing structures. The first sealing structure is above the ports. The second sealing structure is below the ports. Therefore the first sealing structure is sized to limit the escape of oil while releasing the gas from the fluid trap. Other mechanisms of releasing the gas can be included where necessary. Flow rate of a fluid through these sealing structures is an inverse function of viscosity. Therefore the lower viscosity gas will escape at much higher rates than the much more viscous oil. The second sealing structure is sized to handle well conditions. The trap is sized to capture sufficient oil to exceed oil passage through the first and second sealing structures. The collection of excess oil will keep water from entering the trap. Therefore the second sealing structure is lubricated with oil from the trap. The second sealing structure sees the entire pressure difference that occurs during lifting.

The most common sealing structure is a close fit plunger within a barrel, or clearance. There are a number of methods commonly used to calculate fluid slippage for this type of system. Slippage is a function of plunger/barrel diameter, plunger length, fit, fluid viscosity and the pressure difference. The ARCO-HF pump slippage formula is a commonly used and is as follows:

$$\text{Slippage} = 870\frac{DPF^{1.52}}{L\mu}$$

Slippage=Barrels Of Fluid Per Day D=Plunger Diameter (Inches)

P=Pressure Across Plunger (PSI) F=Plunger Barrel Fit (Inches)

L=Plunger Length (Inches) μ=Fluid Viscosity (centipoise)

The above formula can be used to size the clearance between the plunger and barrel thereby defining each sealing structure. The first sealing structure or clearance can be sized to slip all the gas that is expected to travel through the pump. Properly designed rod pump lift systems normally produce small volumes of gas through the pump, if any. If excessive gas is present additional methods of venting gas are added. Oil slippage for the first sealing structure or clearance is also calculated. The fluid would be crude oil. The pressure difference across the first sealing structure is small. The fluids above and below the first sealing structure are hydraulically connected. Therefore a pressure difference would come from the difference between fluid gradients inside and outside the trap. Oil slippage for the second sealing structure would then be determined, while also using the viscosity of the produced crude oil. The pressure across the second sealing structure would be the pressure difference between the inside and outside of the tubing at the level of the pump discharge. The fluid volume of the trap would be constructed to exceed the sum of oil slippage for the first and second sealing structures for a single pump stroke. That trap volume would be increased should oil also slip out any added gas venting methods. The slippage for water through the second sealing structure could also be calculated for comparison.

The process of working through other types of sealing structures is the same. These types of seals would also benefit when lubricated with oil.

On the downstroke the traveling valve opens and the plunger travels through the layers of gas, oil, and water. Near the top of the stroke the gas flows into the trap and out the first sealing structure. The oil then flows up into the trap as the gas leaves. Upon reaching the bottom of the stroke the trap files with oil.

The pump valves reverse during the upstroke. The closed traveling valve is below the fluid trap therefore the second sealing structure is lifting the fluid column. The pressure flow path is from the tubing, through the trap, to the ports and past the second sealing structure. This path forces the trapped oil to slip past the second sealing structure. An oversized trap insures a surplus of oil. The inclusion of a reservoir above the second sealing structure also insures an oil surplus. Oil provides the dual benefits of longer plunger/barrel life and reduced slippage around the plunger. Therefore the pump lasts longer and pumps more fluid.

There are times when a well does not produce sufficient oil to meet plunger needs during the first stroke. In this case the plunger will slip the trapped oil and then slip water. That slipped oil will flow into the barrel below the plunger. Newly produced oil is then added to the previously slipped oil and produced through the plunger. This makes additional oil available to the trap on the next stroke. The recirculation of slipped oil will continue until the trap is filled with oil. Therefore all oil wells should make sufficient oil to fill the trap during normal operations.

The forgoing summary is not intended to summarize each potential embodiment or every aspect of the present disclosure.

DETAILED DESCRIPTION OF THE EMBODIMENTS

The following description may utilize such directional terms as "upper," "lower," "inner," "outer," "inside," "outside," etc. The use of such terms is made with respect to orientation of the figures submitted herewith. However, it is to be understood that such terms may have a different orientation in an actual installation, such that the use of such terms are not to be understood to limit the claimed invention to those particular orientations.

Figure 1:
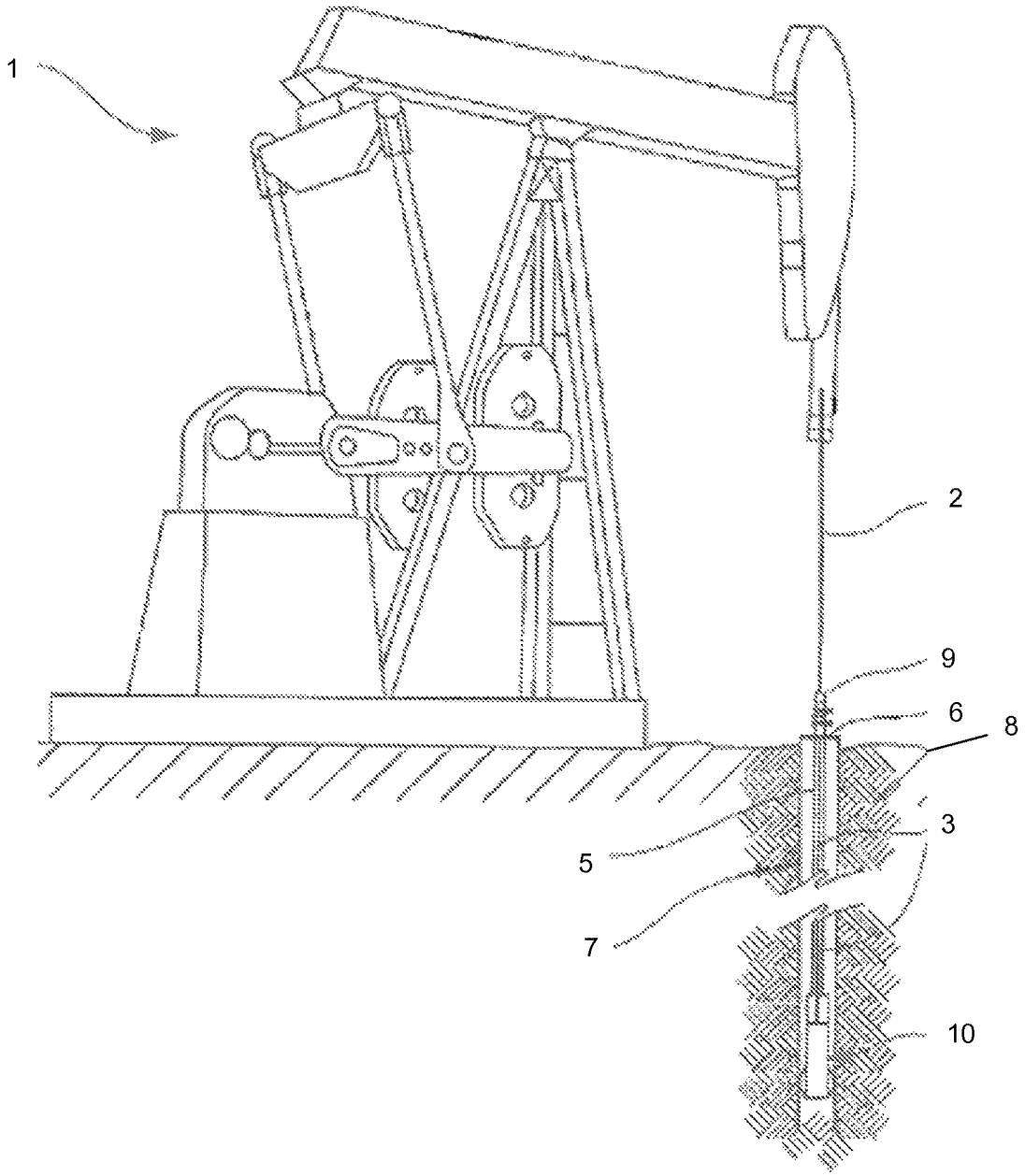
FIG. 1 is a schematic diagram of a rod-pumped well illustrating the downhole pumping equipment.

As can be seen in FIG. 1, in a typical rod pump oil production system, a pumping unit 1 reciprocates a polished rod 2. The polished rod 2 is connected to a plurality of sucker rods 3. The sucker rods 3 are connected to pump 10. Sucker rods 3 are placed concentrically inside tubing 5. Tubing 5 is landed in a wellhead 6. Wellhead 6 is attached to casing 7. Casing 7 is cemented or otherwise sealed in surrounding earth 8.

The subsurface pump 10 is located in tubing 5 at or near a producing formation. Sucker rods 3 extend from the pump 10 up inside the tubing 5 to a polished rod 2 and pass through a stuffing box 9 on the surface. Polished rod 2 is connected to a pump jack unit, or beam pumping unit 1 which reciprocates. It is driven by a prime mover, which can be powered by an electric motor, or a gasoline or diesel or gas engine.

The present embodiment can be used with a variety of surface drive units besides the walking beam pumping unit 1 shown in FIG. 1. For example a ROTAFLEX or hydraulic pumping unit could also be used. The well may also use a variety of connecting members besides sucker rods 3. For example, hollow tubing, or wirelines can be used.

Figure 2:
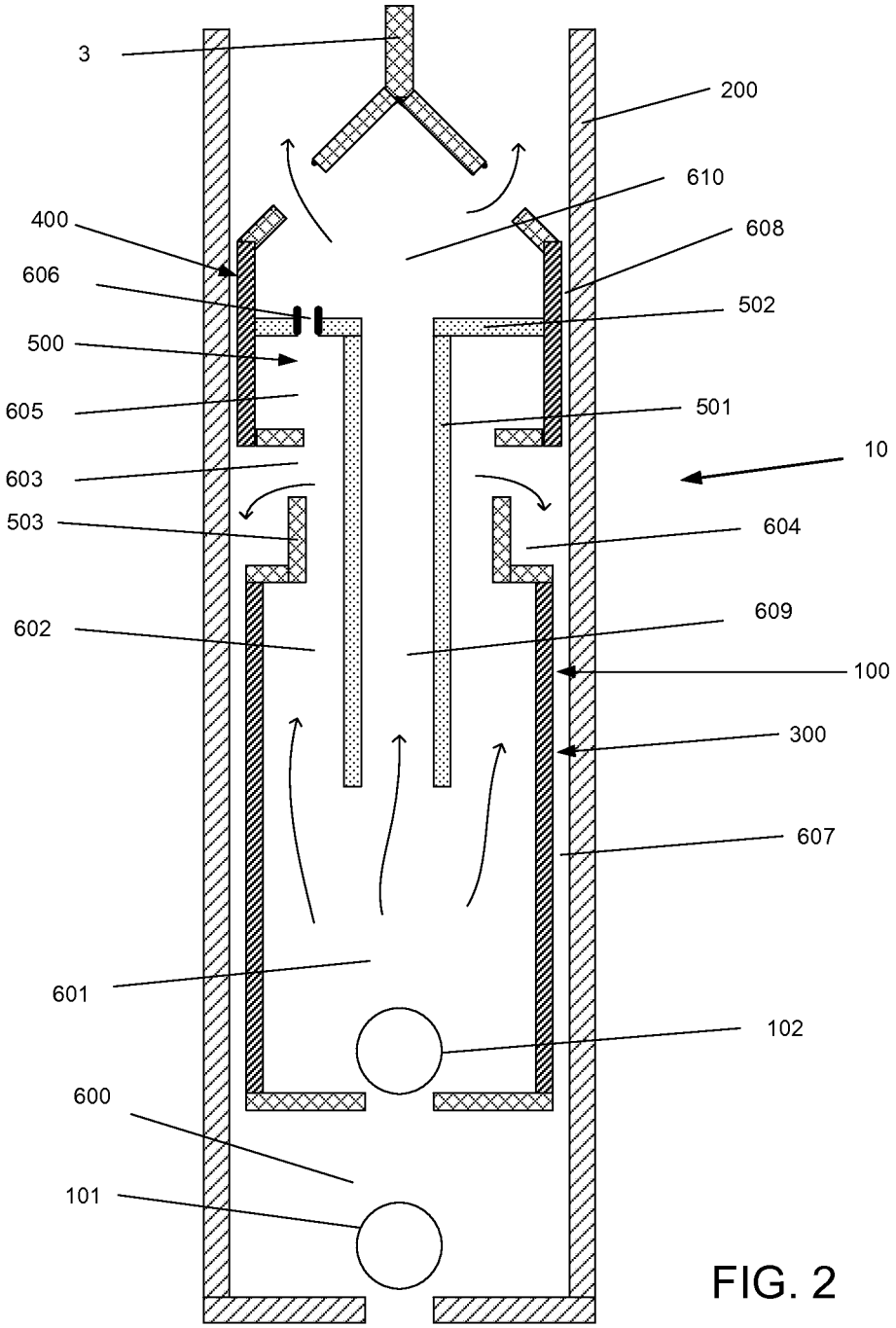
FIG. 2 is a longitudinal cross-sectional schematic view of an embodiment of the present low slip plunger.

FIG. 2 depicts a pump 10 which utilizes a low slip plunger. The pump 10 depicted in FIG. 2 is a stationary barrel pump with a reciprocating plunger 100. The pump 10 comprises a generally cylindrical barrel 200 and a three part generally cylindrical plunger 100 comprising a lower section 300, ports 603 and an upper section 400. The barrel 200 has a standing valve 101 and the lower section 300 has a traveling valve 102. An oil trap 500 is constructed inside plunger 100 having an outlet to the exterior of plunger 100 through port 603. In the illustrations, the valve cages, pump connectors, and other details are not shown. The barrel 200 can be the same types currently used in the petroleum industry. Lower section 300 and upper section 400 of plunger 100 can be constructed from currently available plungers.

The upper section 400 and lower section 300 may be constructed as a single plunger or two separate plungers. A close clearance fluid seal is made between upper section 400 and lower section 300 with barrel 200. An embodiment of the first sealing structure 607 may be defined by the clearance between the lower section 300 and barrel 200. Likewise, an embodiment of the second sealing structure 608 may be defined by the clearance between the upper section 400 and the barrel 200. Clearances defined by the first sealing structure 607 and the second sealing structure 608 are also known as "fit" which is typically between 0.002 and 0.008 inches. It is to be appreciated that other sealing structures art may be utilized for one or both of first sealing structure 607 and second sealing structure 608, such as elastomeric or metallic O-rings, seal rings, cups and other seal mechanisms known in the art.

Lower section 300 and upper section 400 are separated by port 603. Port 603 is a fluid passage which allows fluid flow from the inside of lower section 300 and upper section 400 to the outside of lower section 300 and upper section 400. The number of ports 603 and the fluid channels connecting them are configured in a manner to insure that oil is distributed around the perimeters and exterior surfaces of the lower section 300 and upper section 400. The number of ports 603 increases with larger diameter pumps. Each port 603 is connected to oil trap 500.

Oil trap 500 collects produced fluid as the fluid passes through the pump 10. The key component of oil trap 500 is separating conduit 501. Separating conduit 501 may be constructed from a generally circular tube, and has an opening at the lower end. Wall 502 is attached to the inside of upper section 400 and the separating conduit 501. Wall 502 supports separating conduit 501 thus keeping it in place. A gas vent port 606 may be included near the top of conduit 501 or in wall 502. The gas vent port 606 is sized to pass trapped gas at high rates and oil at low rates. Oil trap 500 may also include an oil storage reservoir 604 which is formed by creating a recess at the top end of lower section 300 with tube 503. The oil storage reservoir 604 and vent port 606 would be used in wells with relatively high gas rates.

Most if not all oil wells produce oil, natural gas, and water through the pump 10. Therefore these fluids will flow into lower plunger chamber 600 on the upstroke. The lower plunger chamber 600 elongates and fills with produced fluid during the upstroke. Dynamometer cards routinely show that the produced gas is at the top of the lower plunger chamber 600 before traveling vale 102 opens. The oil will also begin separating out and move toward the top of lower plunger chamber 600. The gas and oil will extend somewhat horizontally across lower plunger chamber 600.

During the next downstroke the traveling valve 102 opens as plunger 100 moves down through the fluid. The produced fluids, with the gas arriving first, pass into interior chamber 601. These produced fluids are then forced through the oil trap 500. Separating conduit 501 will separate the flow of oil and gas between outer chamber 602 and interior chamber 609. The fluid split will be similar to the ratio of the cross sectional areas of the openings into each chamber. Flow from interior chamber 609 inside conduit 501 will flow into upper chamber 610 and out of pump 10 into the tubing 5. Portions of the gas and oil will also enter outer chamber 602. The velocities in outer chamber 602 are low enough to continue gravity separation of the gas, oil, and water. After the gas and oil flow through outer chamber 602, the gas will flow up into upper outer chamber 605 or through port 603. As upper outer chamber 605 fills with gas it creates an increasing pressure difference across vent port 606. This increasing pressure comes from a column of low density gas contained within upper outer chamber 605 on the outside of conduct 501 and higher density fluids contained within interior chamber 609 on the inside of conduit 501. The fluid gradient differences are large because the gases that had entered interior chamber 609 would have already migrated above gas vent port 606. However, the gas contained within upper outer chamber 605 is trapped until it is leaked off. The upper outer chamber 605 is sized in order to take all the expected gas on each stroke. The resulting pressure difference induces a gas flow through vent port 606. The height of upper outer chamber 605 and the restriction induced by the vent port 606 may be matched to the well's gas production rate through the pump 10 to accommodate this situation. The combination of low viscosity gas and an increased pressure difference would induce relatively high gas venting rates. If well conditions also fill outer chamber 602 with gas, the pressure difference across vent port 606 and second sealing structure 608 will increase. If upper outer chamber 605 is filled with oil the resulting pressure difference across vent port 606 is much smaller, close to zero. The fluid densities on both sides of conduit 501 are very close. The combination of a much smaller pressure difference and a much higher viscosity fluid reduces oil venting to minimal amounts. Should gas also pass through port 603, it would flow through second sealing structure 608 and leave the pump 10. Second sealing structure 608 is sized to vent gas while slipping minimal oil volumes.

Fluids that flow through gas vent 606 and into upper chamber 610 flow up between the rods 3 and tubing 5 to surface and out of the well through wellhead 6. If the well produces minimal gas through the pump 10 then vent 606 may be omitted.

During the downstroke the gas entered the fluid trap near the top of the stroke. Gas vent 606 and second sealing structure 608 are sized in order to insure that all trapped gases have been released before reaching the bottom of the stroke. Therefore the upper chamber 605, oil reservoir 604, and outer chamber 602 are filled with oil at the end of the downstroke. At the beginning of the upstroke traveling valve 102 closes and standing valve 101 opens, Therefore the pressure across the first sealing structure 607 becomes the difference between the pressure inside the lower plunger chamber 600 and interior chamber 601. This pressure difference drives the oil from outer chamber 602 and oil reservoir 604 through the first sealing structure 607. This flow will be controlled by the oil slippage across the lower section 300. Oil flow through the second sealing structure 608, across upper section 400 is small. Outer chamber 602, oil reservoir 604, and upper outer chamber 605 are sized to exceed the volumes of oil expected to leak through the gas vent port 606, first sealing structure 607 and second sealing structure 608 during the upstroke. Oil reservoir 604 can supply oil to the first sealing structure 607 should gas be present at port 603 during the upstroke. This may occur with a transient well inflow period, where a surge of gas pushes all of the oil from outer chamber 602. The oil reservoir 604 could supply a limited volume of oil to sealing structure 607 until oil flow returns.

Close clearance plungers are used to create the first sealing structure 607 and the second clearance structure 608 seals for this embodiment. The ARCO-HF pump slippage formula can be used to calculate the appropriate clearances between lower section 300, upper section 400 and the interior wall of the barrel 200, First sealing structure 607 is defined by the clearance between lower section 300 and the inside wall of barrel 200 would normally be sized for well conditions. Second sealing structure 608 is defined by the clearance between the upper section 400 and the interior wall of the barrel 200 and would normally be sized to slip sufficient gas during the down stroke. It is to be appreciated that the effectiveness of first sealing structure 607 and second sealing structure 608 may be impacted not only by the clearances between the plunger sections and the interior wall of the barrel, but also by the respective lengths of the lower section 300 and upper section 400 of the plunger. The Inventor herein has found that utilizing an upper section 400 which is shorter than the lower section 300 provides effective service.

In many cases the clearance can be reduced from prior operations when the pump slipped water. The concern would be sticking plunger 100 in barrel 200, should the well produce 100% water following a repair or other operation. The slippage may need to be sized for such temporary operations.

Wells which produce very little oil will still benefit from this invention through recycling slipped oil. Some wells may start pumping with insufficient oil to fill outer chamber 602 and oil reservoir 604. Therefore, on that stroke, all the oil collected in these chambers would slip through first sealing structure 607 and flow back into lower plunger chamber 600. This oil is then added to the oil that comes through standing valve 101 on the next upstroke. Therefore the following stroke will have a greater volume of oil available to fill outer chamber 602 and oil reservoir 604. This process continues until the oil trap 500 fills with oil and the water bypasses into interior chamber 609. In order to accelerate that process the pump 10 can be filled with oil before pump 10 is run in the well.

Figure 3:
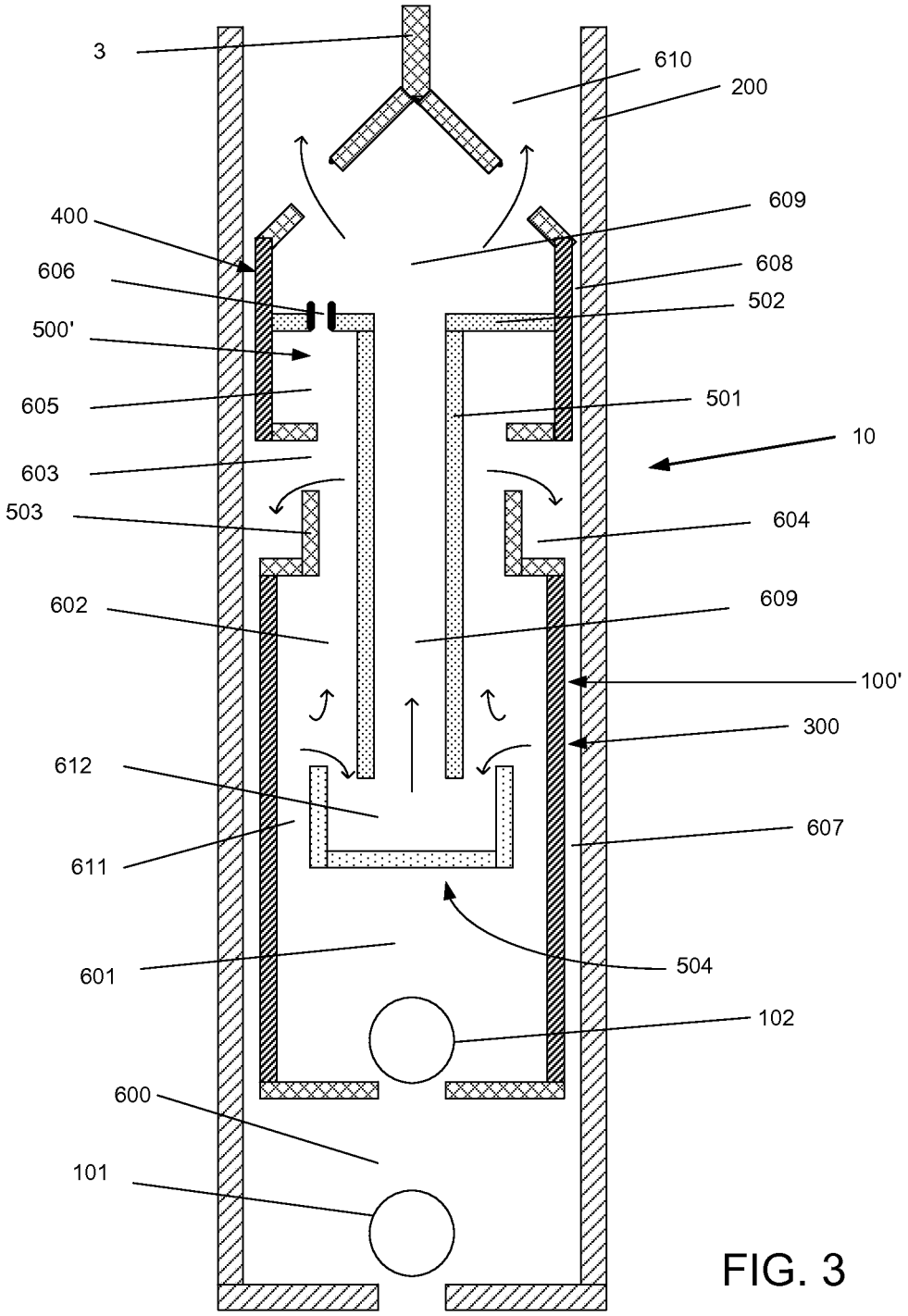
FIG. 3 is a longitudinal cross-sectional schematic view of a second embodiment of the present low slip plunger.

FIG. 3 is a view of pump 10 which illustrates another embodiment of plunger 100' that includes a modified oil trap 500' which may improve the oil recovery efficiency for some wells. For example, this embodiment may be preferred in cases where a well makes very little oil. Plunger 100' comprises a diverter 504 which distinguishes it from the previous embodiment. The diverter 504 defines diverter outer chamber 611 and diverter inner chamber 612, As the produced fluid leaves interior chamber 601 it flows around diverter 504 through diverter outer chamber 611. Some of the flow is goes through outer chamber 602 and exits through port 603. However, another portion of flow changes direction and flow into diverter inner chamber 612 and into interior chamber 609. This modification creates a gravity separator to increase the amount of oil captured by the oil trap 500. The operations before and after fluids encountering diverter 504 remain mechanically the same.

What is claimed is:

1. A downhole pump for lifting wellbore fluids from a hydrocarbon reservoir through a production string to a surface location, the wellbore fluids comprising an oil phase and a water phase, the downhole pump comprising:

a) a barrel having a first one-way valve, the barrel an interior having an interior wall;

b) a plunger disposed inside the barrel, the plunger comprising an interior wall, a lower section and an upper section, the lower section and the upper section each having an exterior wall, the plunger having a length and an interior passage extending through the length, the plunger further comprising a second one-way valve which controls a flow of the wellbore fluids through the interior passage;

c) a first sealing structure defined by a first clearance between the exterior wall of the lower section and a first portion of the interior wall of the barrel adjacent to the lower section as the plunger reciprocates with respect to the barrel;

d) a second sealing structure defined by a second clearance between the exterior wall of the upper section and a second portion of the interior wall of the barrel adjacent to the upper section as the plunger reciprocates with respect to the barrel;

e) an outer chamber formed within the plunger, the outer chamber having an outlet allowing fluid flow out of the interior passage into the interior of the barrel, the outlet disposed between the first clearance and the second clearance; and f) a longitudinally disposed tube suspended within the interior passage, the tube having an opening disposed below the outlet, the tube defining a first flow channel through the inside of the tube through which a first portion of fluid flows into the production string and a second flow channel defined by an annulus formed by an external wall of the tube and the interior wall of the plunger, the second flow channel hydraulically connected to the outer chamber, wherein a second portion of fluid flows through the second flow channel into the outer chamber;

g) wherein the second portion of fluid flows through the outlet into the first clearance and the second clearance thereby lubricating the plunger as it reciprocates with respect to the barrel.

2. The downhole pump of claim 1 wherein the second portion of fluid consists of an oil phase.

3. The downhole pump of claim 1 wherein the first clearance and the second clearance range from 0.002 to 0.008 inches.

4. The downhole pump of claim 1 wherein the first sealing structure includes a secondary seal selected from a group consisting of elastomeric O-rings, metallic O-rings, seal rings, and seal cups.

5. The downhole pump of claim 1 wherein the second sealing structure includes includes a secondary seal selected from a group consisting of elastomeric O-rings, metallic O-rings, seal rings, and seal cups.

6. The downhole pump of claim 1 wherein the outer chamber comprises a gas vent which is hydraulically connected to the production string.

7. The downhole pump of claim 1 wherein the plunger comprises an internal diverter which diverts flow around the opening of the internal conduit such that the first portion of fluid entering the first flow channel has a change in flow direction before entering the opening.

8. A method for reducing fluid slippage in a plunger-barrel combination utilized in an oil well installation which produces a fluid comprising a water phase, an oil phase, and a gas phase wherein the plunger-barrel combination comprises: a) a barrel comprising an interior having an interior wall; b) a plunger disposed inside the barrel, the plunger comprising a lower section and an upper section, the lower section and the upper section each having an exterior wall, the plunger having a length and an interior passage extending through the length; c) a first sealing structure defined by a first clearance between the exterior wall of the lower section and a first portion of the interior wall of the barrel adjacent to the lower section; d) a second sealing structure defined by a second clearance between the exterior wall of the upper section and a second portion of the interior wall of the barrel adjacent to the upper section; e) an internal chamber formed within the plunger, the internal chamber having an outlet allowing fluid flow out of the interior passage into the interior of the barrel, the outlet disposed between the first sealing structure and the second sealing structure, wherein fluid flows through the outlet into the first clearance and the second clearance; wherein the method comprises the following steps:

sizing the second clearance to slip all of the gas phase;

calculating the amount of slippage of the oil phase for the first clearance resulting from a single stroke of the plunger within the barrel to determine a first clearance slippage volume;

calculating the amount of slippage of the oil phase for the second clearance resulting from a single stroke of the plunger within the barrel to determine a second clearance slippage volume; and sizing the volume of the internal chamber to exceed the sum of the amount of the first clearance slippage volume and the second clearance slippage volume.

9. A plunger-barrel combination utilized in an oil well installation which produces a fluid comprising a water phase and an oil phase, wherein the plunger-barrel combination comprises:

a) a barrel comprising an interior having an interior wall;

b) a plunger disposed inside the barrel, the plunger comprising a lower section and an upper section, the lower section and the upper section each having an exterior wall, the plunger having a length and an interior passage extending through the length, wherein an oil reservoir is defined by a recess at a top end of the lower section of the plunger;

c) a first sealing structure defined by a first clearance between the exterior wall of the lower section and a first portion of the interior wall of the barrel adjacent to the lower section;

d) a second sealing structure defined by a second clearance between the exterior wall of the upper section and a second portion of the interior wall of the barrel adjacent to the upper section;

e) an outer chamber formed within the plunger, the outer chamber having an outlet allowing fluid flow out of the interior passage into the interior of the barrel, the outlet disposed between the first sealing structure and the second sealing structure, wherein fluid is directed to flow through the outlet into the first clearance and the second clearance to reduce slippage of fluid through the first clearance and the second clearance.

10. The plunger-barrel combination of claim 9 further comprising a longitudinally disposed internal conduit disposed within the interior passage, the internal conduit having an opening, the internal conduit defining a first flow channel through the inside of the internal conduit through which a first portion of fluid flows into a production string and a second flow channel defined by an annulus formed by the internal conduit and an interior wall of the plunger, the second flow channel hydraulically connected to the outer chamber, wherein a second portion of fluid flows through the second flow channel into the outer chamber.

11. The plunger-barrel combination of claim 10 wherein the second portion of fluid consists of an oil phase.

12. The plunger-barrel combination of claim 10 wherein the outer chamber comprises a gas vent which is hydraulically connected to the production string, the gas vent adapted to release a portion of a gas phase into the production string.

13. The plunger-barrel combination of claim 10 wherein the plunger comprises an internal diverter which diverts flow around the opening of the internal conduit such that the first portion of fluid entering the first flow channel has a change in flow direction before entering the opening.

14. The plunger-barrel combination of claim 10 wherein the plunger comprises an upper chamber through which the first portion of fluid flows as the first portion of fluid flows into the production string.

15. The plunger-barrel combination of claim 14 wherein the upper chamber is sized to accept all of the gas phase flowing through a single reciprocation of the plunger within the barrel.

16. The plunger-barrel combination of claim 9 wherein the first clearance and the second clearance range from 0.002 to 0.008 inches.

17. The plunger-barrel combination of claim 9 wherein the first sealing structure and the second sealing structure include a secondary seal selected from a group consisting of elastomeric O-rings, metallic O-rings, seal rings, and seal cups.

18. The plunger-barrel combination of claim 9 wherein the upper section of the plunger is shorter than the lower section of the plunger.

19. The plunger-barrel combination of claim 9 wherein the barrel comprises a first one-way valve and the plunger comprises a second one-way valve.

* * * * *